US011770653B2

(12) United States Patent
Xiao et al.

(10) Patent No.: US 11,770,653 B2
(45) Date of Patent: Sep. 26, 2023

(54) SPEAKER

(71) Applicant: AAC Microtech (Changzhou) Co., Ltd., Changzhou (CN)

(72) Inventors: Bo Xiao, Shenzhen (CN); Chenliang Kong, Shenzhen (CN); Tong Zhang, Shenzhen (CN); Ronglin Linghu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 36 days.

(21) Appl. No.: 17/536,110

(22) Filed: Nov. 29, 2021

(65) Prior Publication Data

US 2022/0210565 A1 Jun. 30, 2022

(30) Foreign Application Priority Data

Dec. 25, 2020 (CN) ..... 202023203641.7

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01)

(58) Field of Classification Search
CPC . H04R 9/025; H04R 7/18; H04R 7/16; H04R 9/043
See application file for complete search history.

(56) References Cited

U.S. PATENT DOCUMENTS 11,546,695 B2 * 1/2023 Xiao ..... H04R 7/18
2022/0210565 A1 * 6/2022 Xiao ..... H04R 9/043

FOREIGN PATENT DOCUMENTS

CN 110381424 A * 10/2019 ..... H04R 9/02
CN 209526874 U * 10/2019 ..... H04R 1/06
CN 110446145 A * 11/2019 ..... H04R 9/02

* cited by examiner

*Primary Examiner* — Angelica M McKinney
(74) *Attorney, Agent, or Firm* — W&G Law Group

(57) ABSTRACT

Provided is a speaker, including a frame; a vibration unit fixed to the frame; and a magnetic circuit unit driving the vibration unit to vibrate and produce sound. The vibration unit includes a diaphragm and a voice coil; the diaphragm includes a first suspension, a second suspension and a vibrating portion; the magnetic circuit unit is provided with a magnetic gap, and the voice coil is inserted in the magnetic gap; the magnetic circuit unit includes a yoke; and the yoke and the diaphragm are arranged at two opposite sides of the frame; and the vibration unit further includes a fixing ring connected to the magnetic circuit unit; the second suspension surrounds the fixing ring; and the inner peripheral side of the second suspension is fixed to an end of the fixing ring close to the yoke. With this structure, the acoustic performance of the speaker is improved.

9 Claims, 5 Drawing Sheets

A-A

SPEAKER

TECHNICAL FIELD

The present disclosure relates to the field of electro-acoustic conversion, in particular to a speaker for an electronic audio product.

BACKGROUND

With the advent of the Internet era, the number of smart mobile devices continues to rise. Among the innumerous mobile devices, mobile phones are undoubtedly the most common and most portable mobile terminal devices. At present, mobile phones have extremely diverse functions, one of which is a high-quality music function. Therefore, speakers for playing music are widely used in today's smart mobile devices.

In the related art, a speaker includes a frame, a vibration unit fixed to the frame and a magnetic circuit unit driving the vibration unit to vibrate and produce sound. The vibration unit includes a diaphragm fixed to the frame. An outer peripheral side of the diaphragm is fixed to the frame, and an inner peripheral side of the diaphragm is fixed to the magnetic circuit unit. The diaphragm includes a ring-shaped first suspension, a ring-shaped second suspension and a ring-shaped vibrating portion. The first suspension surrounds the second suspension and is spaced apart from the second suspension. An outer peripheral side of the vibrating portion is fixed to a side of the first suspension close to the second suspension, and an inner peripheral side of the vibrating portion is fixed to a side of the second suspension close to the first suspension. An outer peripheral side of the first suspension is fixed to the frame. One end of a holder is fixed to a first diaphragm, and another end of the holder is fixed to a voice coil. The magnetic circuit unit includes a yoke fixed to the frame, a main magnet fixed to the yoke, an auxiliary magnet surrounding the main magnet, and a subsidiary magnet covering a side of the main magnet away from the yoke. The inner peripheral side of the diaphragm is fixed to the subsidiary magnet, and the second suspension surrounds the subsidiary magnet.

However, there is a large height difference between the bonding surface of the second suspension and the subsidiary magnet and the bonding surface of the second suspension and the inner peripheral side of the vibrating portion. As a result, the strain of the second suspension during vibration is increased, and the second suspension is excessively distorted. As a result, the high-frequency sensitivity of the speaker is reduced, and the high-frequency performance of the speaker is deteriorated, resulting in poor acoustic performance of the speaker.

Therefore, it needs to provide a speaker to solve the above technical problem.

SUMMARY

An objective of the present disclosure is to provide a speaker with desirable acoustic performance.

An embodiment of the present disclosure provides a speaker, including a frame; a vibration unit fixed to the frame; and a magnetic circuit unit driving the vibration unit to vibrate and produce sound. The vibration unit includes a diaphragm having a ring shape and a voice coil driving the diaphragm to vibrate and produce sound; the diaphragm includes a first suspension having a ring shape, a second suspension having a ring shape and a vibrating portion having a ring shape; the first suspension surrounds the second suspension and is spaced apart from the second suspension; an outer peripheral side of the vibrating portion is fixed to a side of the first suspension close to the second suspension, and an inner peripheral side of the vibrating portion is fixed to a side of the second suspension close to the first suspension; an outer peripheral side of the first suspension is fixed to the frame; and an inner peripheral side of the second suspension is fixed to the magnetic circuit unit; the magnetic circuit unit is provided with a magnetic gap, and the voice coil is inserted in the magnetic gap; the magnetic circuit unit includes a yoke; and the yoke and the diaphragm are arranged at two opposite sides of the frame; and the vibration unit further includes a fixing ring connected to the magnetic circuit unit; the second suspension surrounds the fixing ring; and the inner peripheral side of the second suspension is fixed to an end of the fixing ring close to the yoke.

As an improvement, the magnetic circuit unit includes a main magnet fixed to the yoke, an auxiliary magnet surrounding the main magnet, and a subsidiary magnet fixed to and covering a side of the main magnet away from the yoke; the auxiliary magnet is spaced apart from the main magnet to form the magnetic gap; and the fixing ring is sleeved outside the subsidiary magnet and is fixed to and connected to the subsidiary magnet.

As an improvement, the subsidiary magnet includes a subsidiary magnet body fixed to a side of the main magnet away from the yoke, and a subsidiary magnet extension portion formed by the subsidiary magnet body protruding away from the yoke; and the fixing ring is sleeved outside the subsidiary magnet extension portion and is fixed to and connected to the subsidiary magnet body.

As an improvement, the second suspension includes a second suspension portion having a ring shape, a second fixing portion bending and extending from an outer peripheral side of the second suspension portion toward the vibrating portion, a third fixing portion bending and extending from an inner peripheral side of the second suspension portion toward the fixing ring, and a fourth fixing portion extending from an end of the third fixing portion away from the second suspension in a direction away from the yoke; the second fixing portion is connected to the vibrating portion; the third fixing portion is fixed to the fixing ring, and a side of the third fixing portion close to the yoke is aligned with a side of the fixing ring close to the yoke; and the fourth fixing portion is attached to an outer side of the fixing ring.

As an improvement, the fixing ring includes a fixing ring body having a ring shape, and a fixing ring reinforcing portion bending and extending from an end of the fixing ring body close to the yoke in a direction away from the subsidiary magnet extension portion; and a side of the fourth fixing portion close to the fixing ring is recessed to form a fixing groove, and the fixing ring reinforcing portion is accommodated and fixed in the fixing groove.

As an improvement, the vibration unit further includes a holder; the holder includes holder body having a ring shape and a first holder fixing portion bending and extending from an inner peripheral side of the holder body toward the voice coil; the holder body is located between the first suspension and the second suspension, and is respectively connected to an inner peripheral side of the first suspension and the outer peripheral side of the second suspension to serve as the vibrating portion; the first holder fixing portion is fixed to an end of the voice coil away from the yoke; and the second fixing portion is fixed to a side of the first holder fixing portion close to the subsidiary magnet body.

As an improvement, the vibration unit further includes a dome having a ring shape; the dome is sandwiched between the first suspension and the second suspension; the dome is spaced apart from the first suspension and the second suspension; and the dome is fixed to a side of the holder body away from the yoke.

As an improvement, the holder further includes a second holder fixing portion bending and extending from an outer peripheral side of the holder body in a direction away from the first suspension; the vibration unit further includes an elastic support assembly surrounding the magnetic circuit unit and spaced apart from the magnetic circuit unit; and a side of the elastic support assembly away from the magnetic circuit unit is fixed to the frame, and a side of the elastic support assembly close to the magnetic circuit unit is fixed to the second holder fixing portion.

As an improvement, the magnetic circuit unit further includes a main pole plate fixedly sandwiched between the main magnet and the subsidiary magnet body, and an auxiliary pole plate fixed to an end of the auxiliary magnet away from the yoke; the auxiliary pole plate includes an auxiliary pole plate body that is ring-shaped and fixed to the auxiliary magnet, and an auxiliary pole plate fixing portion extending from the auxiliary pole plate body toward the frame; and the auxiliary pole plate fixing portion is fixed to the frame.

As an improvement, the fixing ring is made of metal.

Compared with the related art, in the present disclosure, the fixing ring is connected to the magnetic circuit unit, and the inner peripheral side of the second suspension is fixed to an end of the fixing ring close to the yoke. With this structure, a bonding surface of the second suspension and the fixing ring is located at the bottom of the fixing ring. This reduces a height difference between a bonding surface of the second suspension and the subsidiary magnet and a bonding surface of the second suspension and the inner peripheral side of the vibrating portion. Therefore, the strain of the second suspension during vibration is reduced, and a result that the high-frequency sensitivity is reduced due to the excessive distortion of the second suspension is suppressed. In this way, the high-frequency performance of the speaker is improved, thereby achieving desirable acoustic performance of the speaker.

BRIEF DESCRIPTION OF DRAWINGS

To describe the technical solutions in the embodiments of the present disclosure more clearly, the drawings required for describing the embodiments are briefly described below. Apparently, the drawings in the following description show merely some embodiments of the present disclosure, and those of ordinary skill in the art may still derive other drawings from these drawings without creative efforts.

DETAILED DESCRIPTION OF EMBODIMENTS

The technical solutions of the embodiments of the present disclosure are described in detail below with reference to the drawings. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

Figure 1:
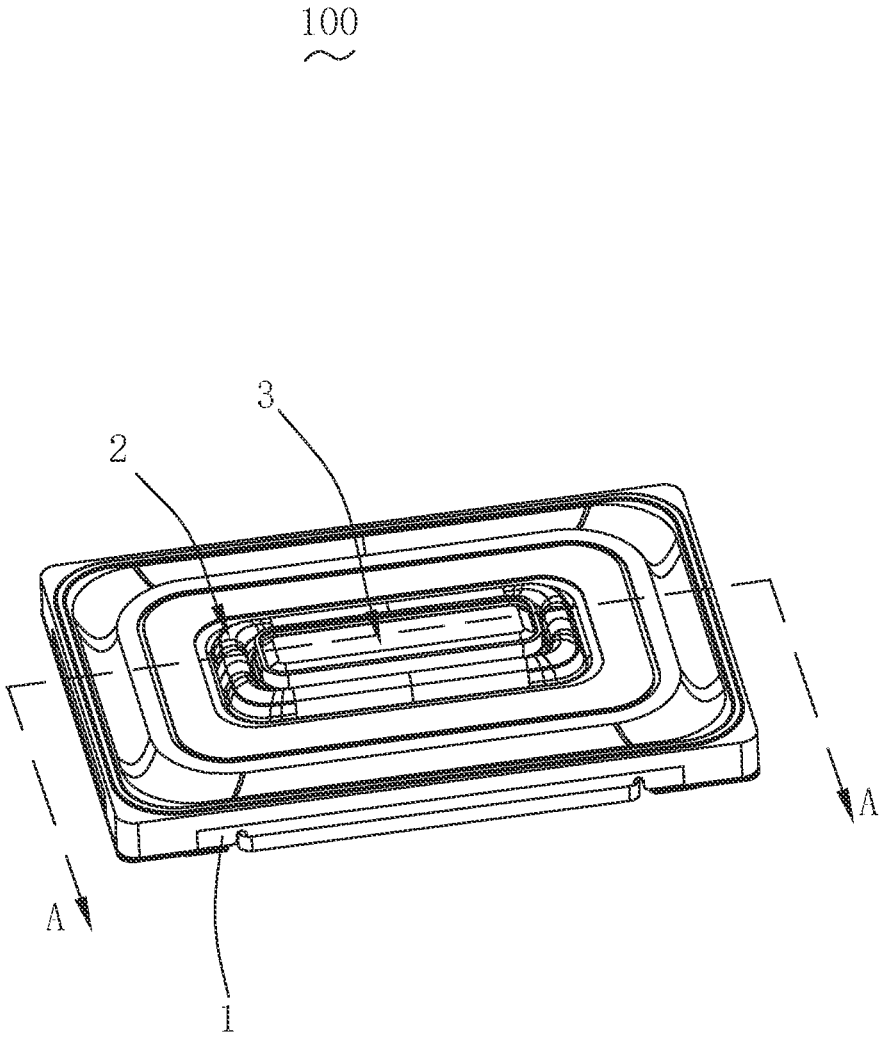
FIG. 1 is a three-dimensional view illustrating a structure of a speaker according to an embodiment of the present disclosure.
Figure 2:
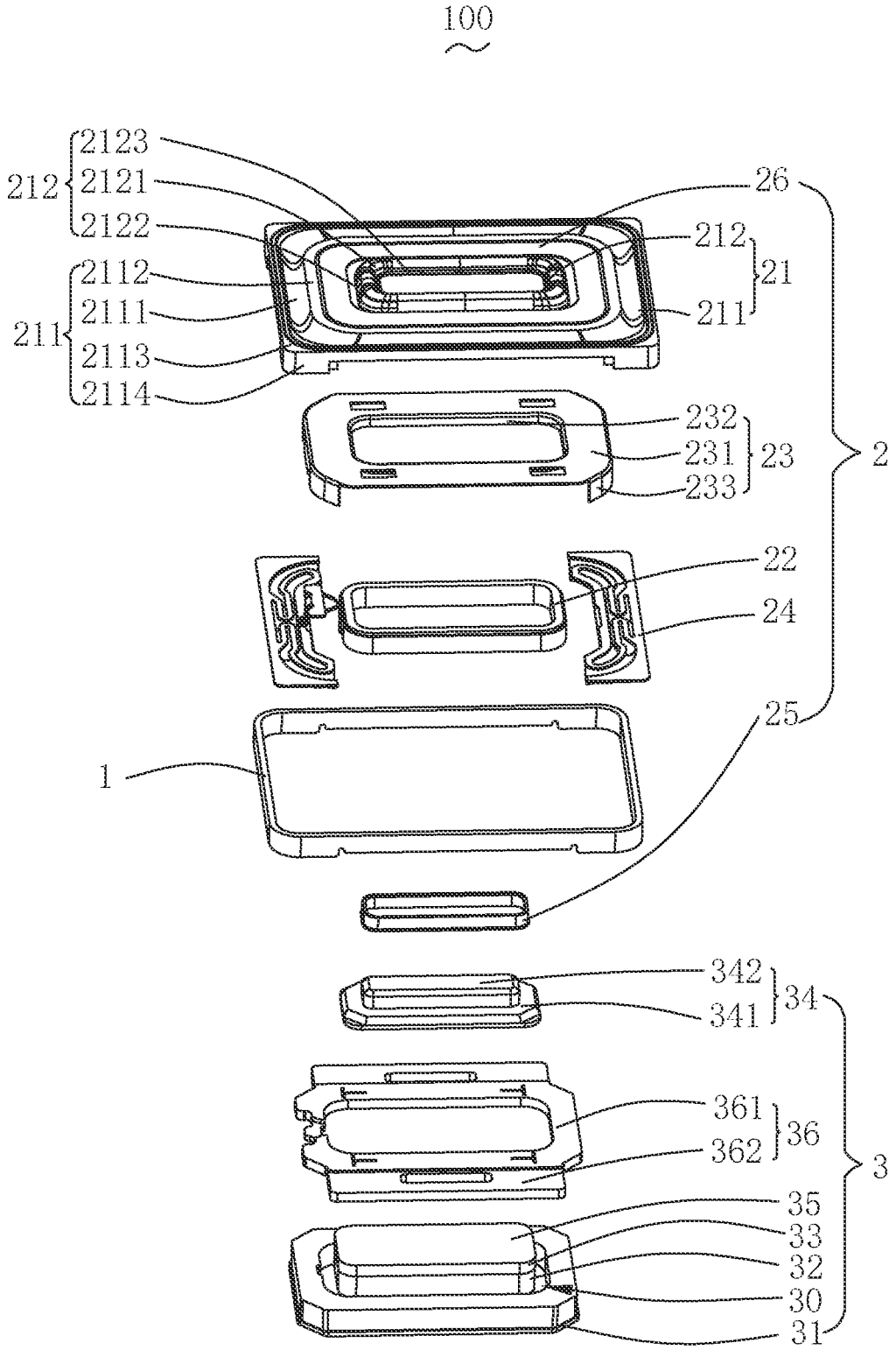
FIG. 2 is a partial three-dimensional exploded view illustrating a structure of a speaker according to an embodiment of the present disclosure.
Figure 3:
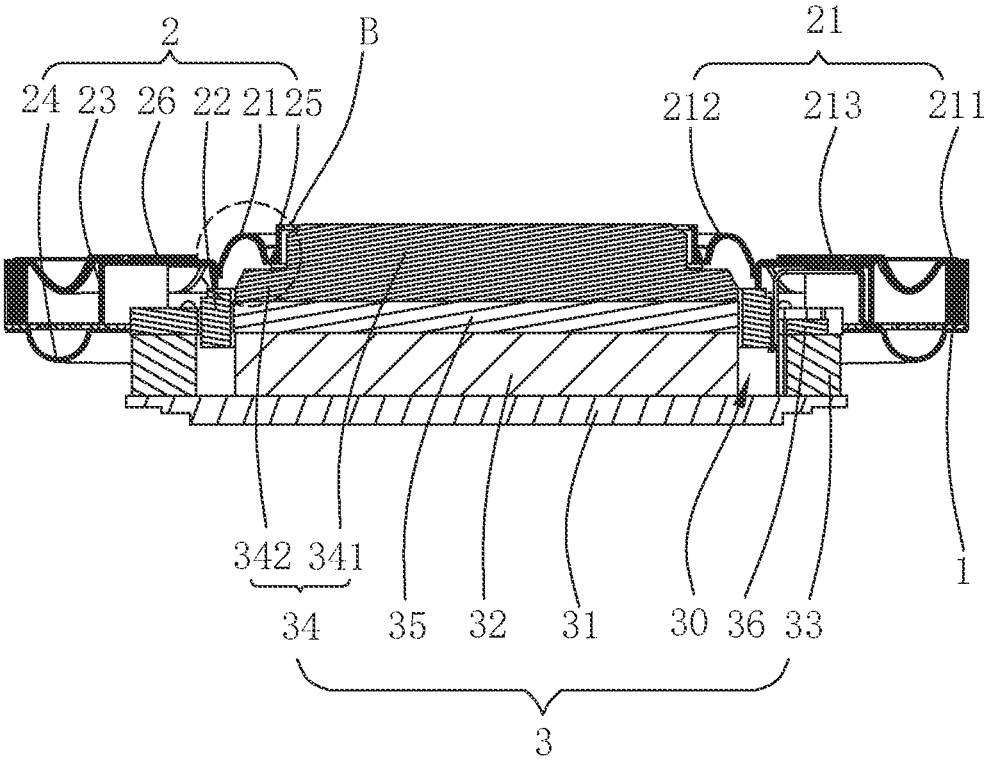
FIG. 3 is a sectional view taken along line A-A shown in FIG. 1.
Figure 4:
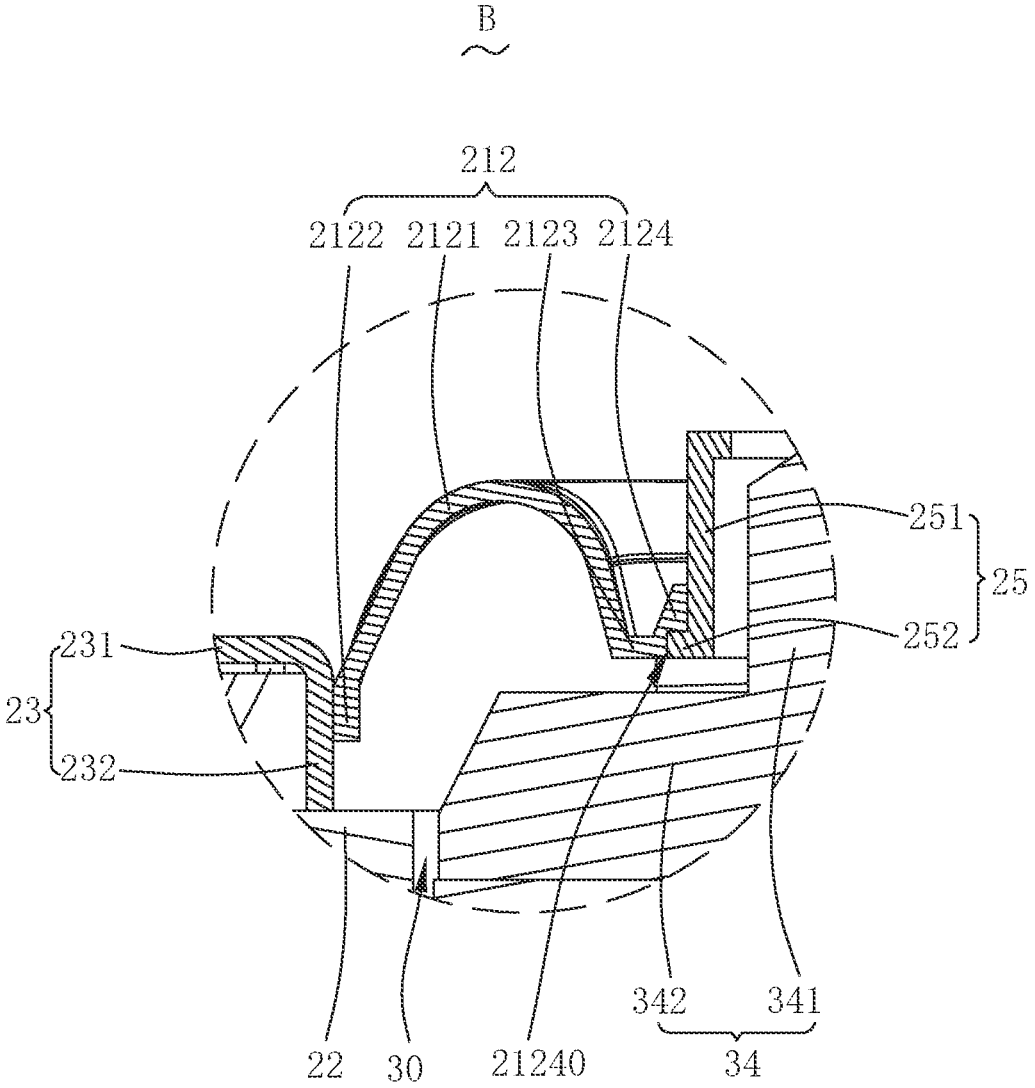
FIG. 4 is an enlarged view of B shown in FIG. 3.
Figure 5:
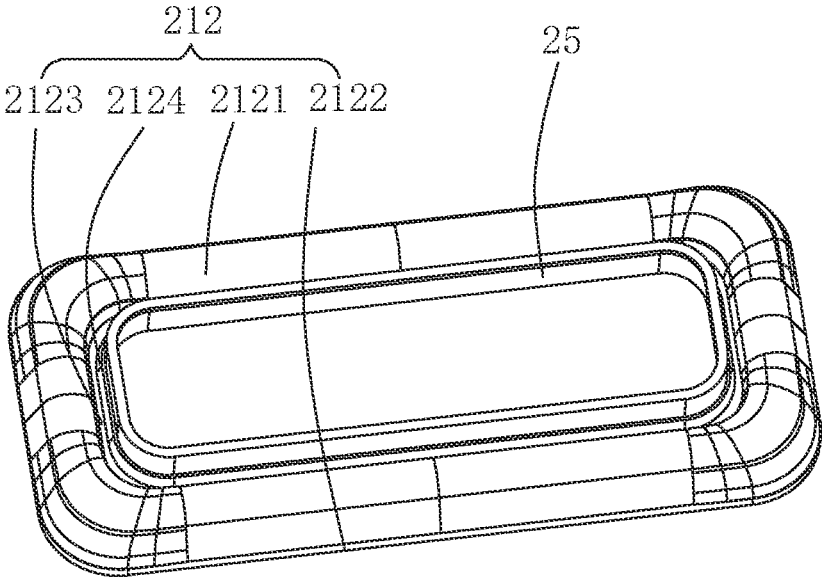
FIG. 5 is a three-dimensional view illustrating a structure of a second suspension and a fixing ring of a speaker according to an embodiment of the present disclosure, after assembly.

Referring to FIG. 1 to FIG. 5, an embodiment of the present disclosure provides a speaker 100. The speaker 100 includes a frame 1, a vibration unit 2 fixed to the frame 1, a magnetic circuit unit 3 for driving the vibration unit 2 to vibrate and produce sound and a fixing ring 4. The magnetic circuit unit 3 is provided with a magnetic gap 30 and a yoke 31 located on a side of the frame 1.

The frame 1 is ring-shaped.

The vibration unit 2 includes a diaphragm 21, a voice coil 22, a holder 23, elastic support assemblies 24 and a fixing ring 25.

The diaphragm 21 includes a ring-shaped first suspension 211, a ring-shaped second suspension 212 and a ring-shaped vibrating portion 213 that are spaced apart from each other. The first suspension 211 surrounds the second suspension 212 and is spaced apart from the second suspension 212. An outer peripheral side of the vibrating portion 213 is fixed to a side of the first suspension 211 close to the second suspension 212, and an inner peripheral side of the vibrating portion 213 is fixed to a side of the second suspension 212 close to the first suspension 211. An outer peripheral side of the first suspension 211 is fixed to the frame 1.

The first suspension 211 is ring-shaped and surrounds the magnetic circuit unit 3. Specifically, the first suspension 211 includes a ring-shaped first suspension portion 2111, a first vibrating portion 2112 bending and extending from an inner peripheral side of the first suspension portion 2111 toward the second suspension 212, and a first fixing portion 2113 bending and extending from an outer peripheral side of the first suspension portion 2111 toward the frame 1. The first fixing portion 2113 is fixed to the frame 1. A cross section of the first suspension portion 2111 has an arc shape.

In this implementation, the first suspension 211 further includes a ring-shaped first reinforcing portion 2114 bending and extending from an outer periphery of the first fixing portion 2113 along an outer peripheral side of the frame 1. The first reinforcing portion 2114 is fixed to the frame 1. The first reinforcing portion 2114 increases the bonding area of the first suspension 211 and the frame 1, thereby improving the reliability of the speaker 100.

The second suspension 212 is ring-shaped. The first suspension 211 surrounds the second suspension 212 and is spaced apart from the second suspension 212. An outer peripheral side of the second suspension 212 is fixed to the inner peripheral side of the vibrating portion 213, and an inner peripheral side of the second suspension 212 is fixed to the magnetic circuit unit 3.

Specifically, the second suspension 212 includes a second suspension portion 2121, a second fixing portion 2122, a third fixing portion 2123 and a fourth fixing portion 2124.

The second suspension portion 2121 is ring-shaped. A cross section of the second suspension portion 2121 has an arc shape.

The second fixing portion 2122 bends and extends from an outer peripheral side of the second suspension portion 2121 toward the vibrating portion 213. The second fixing portion 2122 is connected to the vibrating portion 213.

Specifically, the second fixing portion 2122 is fixed to the inner peripheral side of the vibrating portion 213. In this implementation, the vibrating portion 213 is fixed to the second fixing portion 2122 by gluing.

The third fixing portion 2123 bends and extends from an inner peripheral side of the second suspension portion 2121 toward the magnetic circuit unit 3. The third fixing portion 2123 is fixed to the magnetic circuit unit 3.

The fourth fixing portion 2124 extends from an end of the third fixing portion 2123 away from the second suspension 2121 in a direction away from the yoke 31. The fourth fixing portion 2124 is configured to strengthen the fixing of the magnetic circuit unit 3.

The voice coil 22 is configured to drive the diaphragm 21 to vibrate and produce sound. The voice coil 22 is inserted in the magnetic gap 30.

One end of the holder 23 is fixed to the diaphragm 21, and another end of the holder 23 is fixed to the voice coil 22.

Specifically, the holder 23 includes a holder body 231, a first holder fixing portion 232 and second holder fixing portions 233.

The holder body 231 is ring-shaped. The holder body 231 is located between the first suspension 211 and the second suspension 212, and is respectively connected to an inner peripheral side of the first suspension 211 and an outer peripheral side of the second suspension 212 to serve as the vibrating portion 213. The first vibrating portion 2112 is fixed to a side of the holder body 231 away from the yoke 31. The first vibrating portion 2112 and the holder body 231 are integrated to achieve desirable acoustic performance of the diaphragm 21 and also prevent separation from occurring during vibration.

In this implementation, the vibration unit 2 further includes a ring-shaped dome 26. The dome 26 is sandwiched between the first suspension 211 and the second suspension 212. The dome 26 is spaced apart from the first suspension 211 and the second suspension 212. The dome 26 is fixed to a side of the holder body 231 away from the yoke 31. With this structure, the dome 26, the first vibrating portion 2112 and the holder body 231 are integrated to achieve desirable acoustic performance of the diaphragm 21 and also prevent separation from occurring during vibration.

The first holder fixing portion 232 bends and extends from an inner peripheral side of the holder body 231 toward the voice coil 22. The first holder fixing portion 232 is spaced apart from the magnetic circuit unit 3. The first holder fixing portion 232 is fixed to an end of the voice coil 22 away from the yoke 31, such that the voice coil 22 drives the diaphragm 21 to vibrate and produce sound through the first holder fixing portion 232 and the holder body 231.

The second holder fixing portions 233 bend and extend from an outer peripheral side of the holder body 231 in a direction away from the first suspension 211. The second holder fixing portions 233 are configured to fix the elastic support assemblies 24.

The elastic support assemblies 24 are spaced apart from and opposite to the diaphragm 21. Specifically, sides of the elastic support assemblies 24 away from the magnetic circuit unit 3 are fixed to the frame 1, and sides of the elastic support assemblies 24 close to the magnetic circuit unit 3 are fixed to the second holder fixing portions 233. With this structure, the elastic support assemblies 24 balance the vibration of the voice coil 22.

In this implementation, the voice coil 22 has a rectangular structure, and two elastic support assemblies 24 are provided. The two elastic support assemblies 24 are located at two opposite sides of the voice coil 22. With this structure, the elastic support assemblies 24 stably support the voice coil 22 to ensure vibration reliability, thereby improving the acoustic performance of the diaphragm 21.

The fixing ring 25 is ring-shaped. The third fixing portion 2123 bends and extends from the inner peripheral side of the second suspension portion 2121 toward the fixing ring 25. The second suspension 212 surrounds the fixing ring 25.

The second suspension 212 is fixed to the fixing ring 25. An inner peripheral side of the second suspension 212 is fixed to an end of the fixing ring 25 close to the yoke 31. Specifically, the third fixing portion 2123 is fixed to the fixing ring 25, and a side of the third fixing portion 2123 close to the yoke 31 is aligned with a side of the fixing ring 25 close to the yoke 31. The fourth fixing portion 2124 is attached to an outer side of the fixing ring 25. With this structure, a bonding surface of the second suspension 212 and the fixing ring 25 is located at the bottom of the fixing ring 25. This reduces a height difference between a bonding surface of the second suspension 212 and the subsidiary magnet 34 and a bonding surface of the second suspension 212 and the inner peripheral side of the vibrating portion 213. Therefore, the strain of the second suspension 212 during vibration is reduced, and a result that the high-frequency sensitivity is reduced due to the excessive distortion of the second suspension 212 is suppressed. In this way, the high-frequency performance of the speaker 100 is improved, thereby achieving desirable acoustic performance of the speaker 100.

Since a side of the third fixing portion 2123 close to the yoke 31 is aligned with a side of the fixing ring 25 close to the yoke 31, the assembly is facilitated. In addition, the vibration performance of the diaphragm 21 is improved, thereby improving the acoustic performance of the speaker 100.

In this implementation, the fixing ring 25 includes a ring-shaped fixing ring body 251 and a fixing ring reinforcing portion 252 bending and extending from an end of the fixing ring body 251 close to the yoke 31 in a direction away from a subsidiary magnet extension portion 342. A side of the fourth fixing portion 2124 close to the fixing ring 25 is recessed to form a fixing groove 21240, and the fixing ring reinforcing portion 252 is accommodated and fixed in the fixing groove 21240. This structure makes the fourth fixing portion 2124 more firmly fixed to the fixing ring 25, thereby improving the reliability of the speaker 100.

The fixing ring 25 is a metal ring. The fixing ring 25 is made of a metal material with a greater hardness than that of the diaphragm 21, and the fixing ring 25 is configured to fix the diaphragm 21 to the magnetic circuit unit 3.

In this implementation, the fixing ring 25 is a steel ring, which achieves a simple structure and is easy to assemble.

The magnetic circuit unit 3 includes a yoke 31, a main magnet 32, an auxiliary magnet 33, a subsidiary magnet 34, a fixing ring 25, a main pole plate 35 and an auxiliary pole plate 36.

The yoke 31 and the diaphragm 21 are arranged at two opposite sides of the frame 1.

The main magnet 32 is fixed to the yoke 31.

The auxiliary magnet 33 is fixed to the yoke 31. The auxiliary magnet 33 surrounds the main magnet 32. The auxiliary magnet 33 is spaced apart from the main magnet 32 to form the magnetic gap 30, and the voice coil 22 is inserted in the magnetic gap 30.

The subsidiary magnet 34 covers a side of the main magnet 32 away from the yoke 31. The second suspension 212 surrounds the subsidiary magnet 34.

Specifically, the subsidiary magnet 34 includes a subsidiary magnet body 341 and a subsidiary magnet extension portion 342.

The subsidiary magnet body 341 is fixed to a side of the main magnet 32 away from the yoke 31. The first holder fixing portion 232 is spaced apart from and surrounds the subsidiary magnet body 341. The second fixing portion 2122 is fixed to a side of the first holder fixing portion 232 close to the subsidiary magnet body 341.

The subsidiary magnet extension portion 342 is formed by the subsidiary magnet body 341 protruding away from the yoke 31.

The fixing ring 25 is sleeved outside and fixed to and connected to the subsidiary magnet 34. Specifically, the fixing ring 25 is sleeved outside the subsidiary magnet extension portion 342 and is fixed to and connected to the subsidiary magnet body 341. The fixing ring 25 is configured to fix the second suspension 212 to the subsidiary magnet 34.

The main pole plate 35 is fixedly sandwiched between the main magnet 32 and the subsidiary magnet body 341.

The auxiliary pole plate 36 is fixed to an end of the auxiliary magnet 33 away from the yoke 31.

The auxiliary pole plate 36 includes an auxiliary pole plate body 361 that is ring-shaped and fixed to the auxiliary magnet 33, and auxiliary pole plate fixing portions 362 extending from the auxiliary pole plate body 361 toward the frame 1. The magnetic circuit unit 3 is fixed to the frame 1. Specifically, the auxiliary pole plate fixing portions 362 are fixed to the frame 1. Of course, in other implementations, this purpose may also be achieved by fixing the yoke 31 to the frame 1.

In this implementation, two auxiliary pole plate fixing portions 362 are provided. The two auxiliary pole plate fixing portions 362 are located at two other opposite sides of the voice coil 22. With this structure, the two auxiliary pole plate fixing portions 362 are fixed to the frame 1, thereby improving the reliability of fixing the magnetic circuit unit 3 to the frame 1.

Compared with the related art, in the present disclosure, the fixing ring is connected to the magnetic circuit unit, and the inner peripheral side of the second suspension is fixed to an end of the fixing ring close to the yoke. With this structure, a bonding surface of the second suspension and the fixing ring is located at the bottom of the fixing ring. This reduces a height difference between a bonding surface of the second suspension and the subsidiary magnet and a bonding surface of the second suspension and the inner peripheral side of the vibrating portion. Therefore, the strain of the second suspension during vibration is reduced, and a result that the high-frequency sensitivity is reduced due to the excessive distortion of the second suspension is suppressed. In this way, the high-frequency performance of the speaker is improved, thereby achieving desirable acoustic performance of the speaker.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising:

a frame;

a vibration unit fixed to the frame; and a magnetic circuit unit driving the vibration unit to vibrate and produce sound, wherein the vibration unit comprises a diaphragm having a ring shape and a voice coil driving the diaphragm to vibrate and produce sound; the diaphragm comprises a first suspension having a ring shape, a second suspension having a ring shape and a vibrating portion having a ring shape; the first suspension surrounds the second suspension and is spaced apart from the second suspension; an outer peripheral side of the vibrating portion is fixed to a side of the first suspension close to the second suspension, and an inner peripheral side of the vibrating portion is fixed to a side of the second suspension close to the first suspension; an outer peripheral side of the first suspension is fixed to the frame; and an inner peripheral side of the second suspension is fixed to the magnetic circuit unit;

the magnetic circuit unit is provided with a magnetic gap, and the voice coil is inserted in the magnetic gap; the magnetic circuit unit comprises a yoke; and the yoke and the diaphragm are arranged at two opposite sides of the frame; and the vibration unit further comprises a fixing ring connected to the magnetic circuit unit; the second suspension surrounds the fixing ring; and the inner peripheral side of the second suspension is fixed to an end of the fixing ring close to the yoke;

wherein the magnetic circuit unit comprises a main magnet fixed to the yoke, an auxiliary magnet surrounding the main magnet, and a subsidiary magnet fixed to and covering a side of the main magnet away from the yoke; the auxiliary magnet is spaced apart from the main magnet to form the magnetic gap; and the fixing ring is sleeved outside the subsidiary magnet and is fixed to and connected to the subsidiary magnet.

2. The speaker as described in claim 1, wherein the subsidiary magnet comprises a subsidiary magnet body fixed to a side of the main magnet away from the yoke, and a subsidiary magnet extension portion formed by the subsidiary magnet body protruding away from the yoke; and the fixing ring is sleeved outside the subsidiary magnet extension portion and is fixed to and connected to the subsidiary magnet body.

3. The speaker as described in claim 2, wherein the second suspension comprises a second suspension portion having a ring shape, a second fixing portion bending and extending from an outer peripheral side of the second suspension portion toward the vibrating portion, a third fixing portion bending and extending from an inner peripheral side of the second suspension portion toward the fixing ring, and a fourth fixing portion extending from an end of the third fixing portion away from the second suspension in a direction away from the yoke; the second fixing portion is connected to the vibrating portion; the third fixing portion is fixed to the fixing ring, and a side of the third fixing portion close to the yoke is aligned with a side of the fixing ring close to the yoke; and the fourth fixing portion is attached to an outer side of the fixing ring.

4. The speaker as described in claim 3, wherein the fixing ring comprises a fixing ring body having a ring shape, and a fixing ring reinforcing portion bending and extending from an end of the fixing ring body close to the yoke in a direction away from the subsidiary magnet extension portion; and a side of the fourth fixing portion close to the fixing ring is recessed to form a fixing groove, and the fixing ring reinforcing portion is accommodated and fixed in the fixing groove.

5. The speaker as described in claim 3, wherein the vibration unit further comprises a holder; the holder comprises holder body having a ring shape and a first holder fixing portion bending and extending from an inner peripheral side of the holder body toward the voice coil; the holder body is located between the first suspension and the second suspension, and is respectively connected to an inner peripheral side of the first suspension and the outer peripheral side of the second suspension to serve as the vibrating portion; the first holder fixing portion is fixed to an end of the voice coil away from the yoke; and the second fixing portion is fixed to a side of the first holder fixing portion close to the subsidiary magnet body.

6. The speaker as described in claim 5, wherein the vibration unit further comprises a dome having a ring shape; the dome is sandwiched between the first suspension and the second suspension; the dome is spaced apart from the first suspension and the second suspension; and the dome is fixed to a side of the holder body away from the yoke.

7. The speaker as described in claim 5, wherein the holder further comprises a second holder fixing portion bending and extending from an outer peripheral side of the holder body in a direction away from the first suspension; the vibration unit further comprises an elastic support assembly surrounding the magnetic circuit unit and spaced apart from the magnetic circuit unit; and a side of the elastic support assembly away from the magnetic circuit unit is fixed to the frame, and a side of the elastic support assembly close to the magnetic circuit unit is fixed to the second holder fixing portion.

8. The speaker as described in claim 2, wherein the magnetic circuit unit further comprises a main pole plate fixedly sandwiched between the main magnet and the subsidiary magnet body, and an auxiliary pole plate fixed to an end of the auxiliary magnet away from the yoke; the auxiliary pole plate comprises an auxiliary pole plate body that is ring-shaped and fixed to the auxiliary magnet, and an auxiliary pole plate fixing portion extending from the auxiliary pole plate body toward the frame; and the auxiliary pole plate fixing portion is fixed to the frame.

9. The speaker as described in claim 1, wherein the fixing ring is made of metal.

* * * * *